10/8/85 XR 4,546,425

United States Patent [19]

Breitholtz

[11] Patent Number: 4,546,425

[45] Date of Patent: Oct. 8, 1985

[54] PROCEDURE AND DEVICE FOR OPTIMATION OF THE VIBRATION AMPLITUDE IN VIBRATORY ROLLERS

[75] Inventor: Claes Breitholtz, Lyckeby, Sweden

[73] Assignee: Dynapac Maskin AB, Solna, Sweden

[21] Appl. No.: 478,275

[22] Filed: Mar. 24, 1983

[30] Foreign Application Priority Data

Apr. 1, 1982 [SE] Sweden ..... 8202103

[51] Int. Cl.[4] ..... B06B 1/16; E01C 19/28

[52] U.S. Cl. ..... 364/153; 364/154; 364/155; 364/500; 364/551; 73/660; 73/672; 74/87; 366/128; 404/103; 404/117; 404/122

[58] Field of Search ..... 73/649, 660, 672; 74/61, 87; 318/608, 648; 364/153, 154, 155, 508, 551, 552, 571, 463, 472; 366/128; 404/103, 113, 117, 122

[56] References Cited

U.S. PATENT DOCUMENTS

| | | | |
|---|---|---|---|
| 3,599,543 | 8/1971 | Kerridge | 94/50 |
| 3,775,019 | 11/1973 | Konig et al. | 404/133 |
| 3,797,954 | 3/1974 | Harris | 404/117 |
| 4,103,554 | 8/1978 | Thurner | 73/573 |
| 4,221,499 | 9/1980 | Breitholz et al. | 404/117 |
| 4,320,643 | 3/1982 | Yasuda et al. | 364/472 X |
| 4,330,738 | 5/1982 | Paramythioti et al. | 318/128 |
| 4,454,780 | 6/1984 | Goehler et al. | 404/117 X |

FOREIGN PATENT DOCUMENTS 1372567 10/1974 United Kingdom .

*Primary Examiner*—Jerry Smith
*Assistant Examiner*—Allen MacDonald
*Attorney, Agent, or Firm*—Brumbaugh, Graves, Donohue & Raymond

[57] ABSTRACT

A method is disclosed for providing optimal compaction of various materials by controlling the vibration amplitude of an adjustable amplitude vibratory roller. The vibration amplitude is automatically reduced when excessively high jolting forces are sensed by transducers carried by the roller or its frame. The apparatus for carrying out the method includes a continuously adjustable eccentric element in the vibratory roller, at least two signal transducers mounted on the roller drum or frame and axially separated, to generate signals representing the vibrational movement of the roller. A regulating system responsive to the signals from the signal transducers reset the adjustable eccentric element to vary the vibration amplitude and provide optimal compaction.

15 Claims, 4 Drawing Figures

PROCEDURE AND DEVICE FOR OPTIMATION OF THE VIBRATION AMPLITUDE IN VIBRATORY ROLLERS

BACKGROUND OF THE INVENTION

In compacting of soil, asphalt and similar materials with vibratory rollers, the vibration amplitude has proved to be of decisive importance for the compaction effect of the roller. An increase in amplitude normally increases the degree of compaction and also its depth effect, something which is true over the entire vibration frequency range. This is particularly the case for rubble, stony moraine and cohesive soils.

When the material being compacted becomes excessively hard, a vibratory roller may, however, begin to vibrate highly irregularly, whereupon the entire roller drum or parts thereof leave the surface of the ground. These vibrations are experienced as bouncing or asymmetric vibrations. In the event of such severe vibrations, the frame of the roller and the driver platform begin to shake and the rubber elements between the roller and frame are subjected to abnormal wear.

Normally, compaction of the material is not improved through the severely irregular vibrations and, in many cases, the degree of compaction will be reduced under the influence of excessively violent jolts against the ground by the roller.

SUMMARY OF THE INVENTION

The present invention relates to a method for providing optimal compaction of various materials by controlling the vibration amplitude of an adjustable amplitude vibratory roller. This objective is accomplished by automatically reducing the vibration amplitude when excessively high jolting forces are sensed by transducers. A further object of the procedure according to the invention is to accomplish a continuous increase in the vibration amplitude for as long as the vibrational movement of the roller drum is regular or for as long as the irregularity of the motion does not exceed certain selected magnitudes.

The invention also relates to apparatus for performance of the method. The apparatus includes a continuously adjustable eccentric element in the vibratory roller, and two or three signal transducers, for example accelerometers, mounted on the roller drum or roller frame, for generation of signals which represent the vibrational movement of the roller. Also included is a control system responsive to the signals from the signal transducers to reset the adjustable eccentric element to vary the vibration amplitude.

Control of the vibration amplitude can appropriately take place by means of an electronic regulating system which is connected to the resetting mechanism of the eccentric element. The system receives signals from the signal transducers and, as long as the vibrational motion of the roller drum is uniform, it emits a signal to the resetting mechanism to gradually increase the vibration amplitude. When the signals from the signal transducers, mounted on different locations inside the roller drum, have different waveforms or, in other words, instantaneously different intensities, and the divergence in waveforms or instantaneous intensity reached a selected reference value, which marks irregular running or vibration of the roller, the amplitude of vibration is gradually reduced until uniform or regular vibrations are again sensed by the transducers. When that occurs, the system provides signals to the control apparatus to adjust the continuously adjustable eccentric element to gradually increase its vibration amplitude, and the previously described cycle is repeated.

The invention will be more readily understood when the following description is read in connection with the accompanying drawings.

DETAILED DESCRIPTION OF A PREFERRED EMBODIMENT

The invention can be embodied in known types of continuously adjustable amplitude vibrators. Examples of continuously adjustable vibrators include the vibrator disclosed in U.S. Pat. No. 4,221,499, issued to the assignee of the present application, the vibrator disclosed in U.S. Pat. No. 4,481,835, issued to the assignee of the present application, and the vibrator described in U.S. patent application Ser. No. 464,465, filed Feb. 7, 1983, in the name of Alfredo Bueno and assigned to the assignee of the present application.

Figure 1:
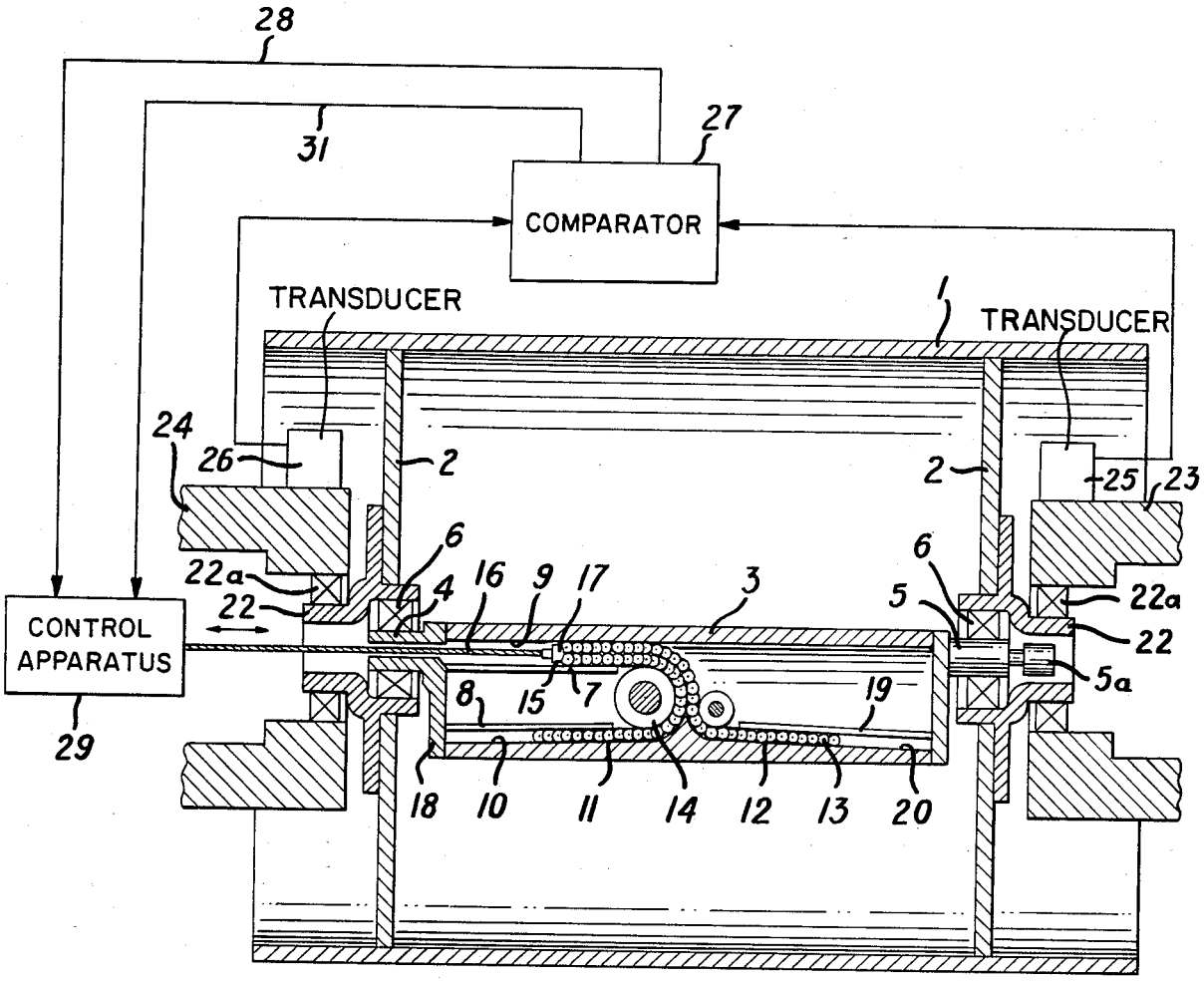
FIG. 1 illustrates an arrangement of signal transducers on a continuously adjustable amplitude vibratory roller and comparing and control devices to optimize and regulate vibration amplitude in accordance with the invention.

Referring to FIG. 1, which discloses the vibrator described in U.S. patent application Ser. No. 464,465, a vibratory roller 1 has a pair of end walls 2 in which an eccentric shaft 3 is rotatably journalled. In the illustrative example shown, eccentric shaft 3 is tubular with bearing journals 4 and 5 applied to either end of the tube. These bearing journals carry the tube and are journalled in the roller end walls in bearings 6. The journal 5 includes a drive element 5*a*, which extends from the bearing 6 and can be coupled to a drive source (not shown) for rotating the shaft 3. When the shaft 3 is rotated, it imparts a vibration-generating rotational movement to the vibratory roller 1.

Two radially separated slide plates 7 and 8 are arranged inside the tubular shaft 3 essentially parallel to the inner wall of the tube. Together, the slide plates and sections 9 and 10 of the inner wall of shaft 3, opposite the slide plates, form guide surfaces for two elongated, flexible eccentric mass elements 11 and 12, which can slide along these surfaces. The flexible eccentric mass elements 11 and 12 are constructed in essentially the same manner as a known bicycle chain, being composed of a number of pivot-link mass elements 13, which together constitute a total mass of the eccentric mass element.

The part of the chain-like mass element 11 that is guided by the aforementioned guide surfaces 7 and 9 is axially oriented in relation to the shaft 3 and coincides essentially with the axis of rotation of the tubular shaft 3. The element 11 extends about a guide pulley 14 in the middle of the tube and down between slide plate 8 and inner wall section 10 of the tube 3.

As the shaft 3 rotates, the portion of the mass element 11 along slide surfaces 7, 9 produce little if any eccentric force. The portions of mass element 11 which extend about pulley 14 and along slide surfaces 8, 10, in contrast, are spaced from the rotational axis of the shaft 3, and thereby impart eccentric force to the shaft 3 and roller 1.

A sleeve-like element 15 has a yoke portion which is pivotably attached to the terminal mass element 13. A control cable 16 is rotatably mounted in the end of the sleeve 15, in bearing 17. The cable 16 extends along the axis of the shaft 3, passing through a hole in the bearing journal 4.

The mass elements 13 in the chain-like eccentric mass element 11 are so distributed in relation to the axis of rotation of the tube 3 that the mass elements 13 that lie in contact with the pulley 14 are acted upon during rotation of the shaft 3 by centrifugal forces that strive to push the chain 11 in between the guide surfaces 8 and 10.

The force that causes this sliding of the chain 11 can be increased by orienting the guide surfaces 8 and 10, in relation to tha axis of rotation of the tube 3, in the manner shown so that the mass elements 13 are continuously moved farther away from the axis of rotation of the tube 3 as they are pushed in between the aforementioned surfaces, or in other words so that they form an angle with the axis of rotation of the tube 3.

The centrifugal force acting on the chain 11 during rotation can be counteracted by applying a tensile force to tension cable 16. At the lowest amplitude, the chain 11 with its cable sleeve 15 is flush up against end wall 18. In the opposite position, i.e., at maximum amplitude, the cable is let out such that the sleeve 15 is in contact with the pulley 14.

In order to distribute the vibratory force generated during rotation along the entire length of the tube and thereby distribute the load equally on the two bearing journals 4 and 5, an additional eccentric mass element 12 is disposed inside the tube 3. It is suitably arranged so that the part of the chain 12 that is connected with the tension cable 16 is integrated with the corresponding part of element 11, whereby the cable sleeve 15 is common to the two elements 11, 12.

Disposed around the periphery of journals 22 are bearings **22*a* located in frame members 23 and 24 which form part of a machine supported by the vibratory roller 1. Positioned on the frame members 23 and 24 are two transducers 25 and 26 for generating signals representative of vibrations of the frame members. At least two transducers axially separated from each other must be used. The axis of interest is that of the roller 1. As positioned, the vertical components of the vibrations are measured but other components may also be sensed. Further, the transducers can be mounted in the roller 1 to measure the vibratory forces. The transducers 25 and 26** for sensing the vibratory motion of the frame members may be, for example, an accelerometer of Type 4393 manufactured by Bruel & Kjaer. Other known transducers sensing vibratory motion and generating representative signals may also be used.

The signals from the transducers 25 and 26 are coupled to an electronic circuit 27 designated comparator in FIG. 1. The circuits 27 compare the signals received from the transducers 25 and 26. When the signals indicate that the vibratory motion of the roller drum 1 is essentially uniform or regular, i.e., the signals from transducers 25 and 26 are substantially the same and have the same instantaneous amplitudes, a signal is provided on electrical coupling 28 to control apparatus 29 to cause gradual motion of the cable 16 to the right. Such cable movement gradually increases the vibration amplitude of roller 1.

Figure 3:
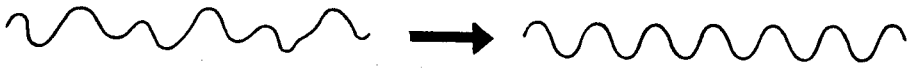
FIG. 3 shows the vibratory curves of the roller without amplitude control and with amplitude control in accordance with the invention.

When the vibrational motion of the roller drum 1 starts becoming asymmetric, i.e., deviating from an essentially sinusoidal or regular curve as shown in curve A of FIG. 3, the signals provided by the transducers 25 and 26 are no longer substantially identical but become irregular and differ, i.e., their amplitudes at any instant are different. When the waveform of the vibrations of the roller 1 becomes irregular to a selected magnitude, such irregularity causes the comparator 27 to change modes and switch its output signal to line 31. When the signal on line 31 is received by the control apparatus 29, it causes gradual motion of the cable 16 to the left, thereby gradually diminishing the vibration amplitude of the roller 1.

Note that the permissible deviation of the instantaneous amplitudes of the transducer signals, i.e., of the vibration curve from a regular or sinusoidal shape, prior to mode switching of the comparator 27, is controlled by varying the parameters of the comparator. Such permissible deviations are different for different soils or layer thicknesses. Moreover by providing adjustable limits in the control apparatus 29, the maximum vibration amplitude can be limited for certain applications by a simple preselector.

It is a routine matter for a person skilled in the art to provide a comparator 27 to function as described using commercially available circuits and information. The same holds true for providing the control apparatus 29. Thus the comparator 27 and control apparatus 29 by themselves are not inventive, and any circuits and apparatus performing their stated functions may be used.

To understand the need for the present invention, note that when the vibratory roller 1 is moved across a surface to be compacted the first time, assuming the surface is somewhat soft and resilient, the vibration curve of the roller sensed by the transducers 25 and 26 will be essentially regular or sinusoidal as shown in curve A of FIG. 3. As compaction of the material progresses during successive passes of the vibratory roller, the vibration curves change. Curve B shows the vibrations of the roller after seven passes, curve C after nine passes, and curve D after nineteen passes. Note that the curves after nine and nineteen passes are extremely irregular, while the curve after seven passes is only moderately irregular.

Figure 4:
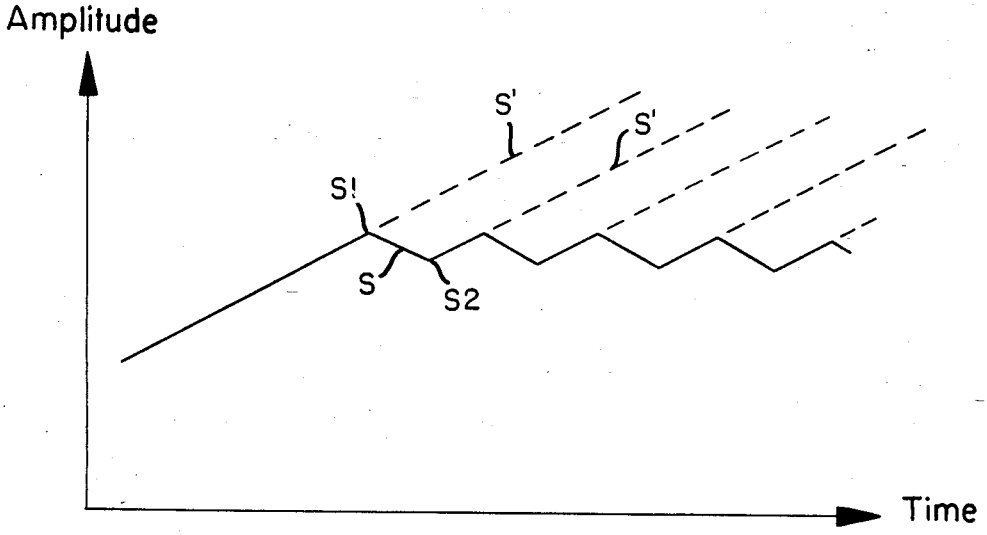
FIG. 4 is a graph showing how the amplitude curve of the vibratory roller rises and falls when amplitude control is used according to the present invention.

In order to prevent the vibratory roller from bouncing and experiencing asymmetric or irregular vibrations, sometimes referred to as cradle vibrations, such as shown in curves C and D, the amplitude control of the invention is used. Referring to the graph of FIG. 4, it shows the amplitude of vibrations of the vibratory roller plotted against time. FIG. 4 illustrates how the vibration amplitude of the roller 1 swings around an optimal value during the regulation cycle resulting from the present invention. The sawtooth curve S in FIG. 4 initially increases gradually as the control apparatus 29 causes movement of the cable 16 to the right, thereby increasing the vibration amplitude of the roller 1. Such movement is provided by the control apparatus 29 when the transducer signals sensed by the comparator 27 are substantially regular and similar, as shown, for example in curve A of FIG. 3.

At point S1 of curve S in FIG. 4, the signals sensed by the comparator 27 are sufficiently dissimilar and irregular to cause the comparator 27 to change its mode and cease providing a signal on line 28 and provide a signal on line 31 to the control apparatus 29. For example, the vibration curve of the roller 1 may be as shown in curve B of FIG. 2 when the change occurs in the output of comparator 27. At this time, the roller 1 may be on the verge of bouncing or asymmetric vibrations which should be avoided. The signal on line 31 causes the control apparatus 29 to move the cable 16 gradually to the left, thereby decreasing the vibration amplitude of the roller 1 as shown in FIG. 4.

Figure 2:
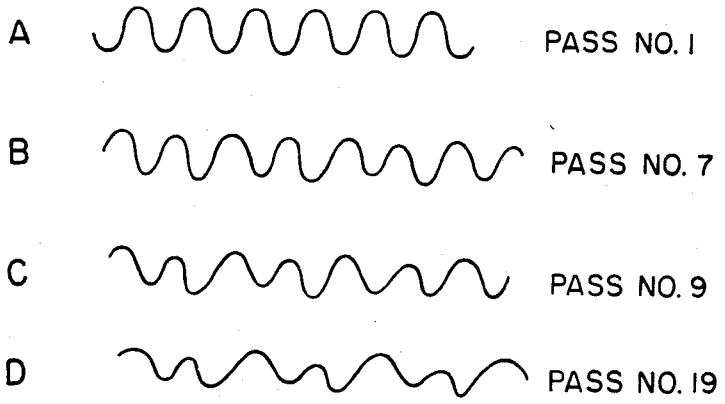
FIG. 2 illustrates vibration curves of a vibratory roller for different numbers of passes.

When the vibration amplitude of the roller 1 is reduced to S2, the vibrations of the roller 1 are regular and output signals from the transducers 25 and 26 are again regular and similar, such as shown in curve A of FIG. 2. The comparator 27 then switches its output to line 28 to cause control apparatus 29 to move the cable 16 gradually to the right, thereby gradually increasing the amplitude of vibration of the roller 1. This process continues, as shown in FIG. 4, so that at no time does the roller 1 produce severe and irregular vibrations with excessive violent jolts against the ground. Note that without the mode switching of the comparator 27, the amplitude of the roller 1 would increase as indicated by the dashed lines S' in FIG. 4.

Stated in other words, the criterion for interruption of the increase and initiation of gradual decrease in vibration amplitude of the roller 1 is that an unacceptably large value of irregular vibrations of the roller occurs. As soon as the deviation from regular or sinusoidal vibrations has become acceptable, as determined by the parameters in the comparator 27, the amplitude of vibrations again begins to increase and the cycle is repeated.

FIG. 3 illustrates the advantages of using amplitude control. The curve at the left shows irregular and destructive type vibrations experienced after many passes if vibration amplitude is not diminished. With amplitude control, the vibration curve becomes essentially sinusoidal or regular as shown to the right in FIG. 3 after the same number of passes.

While the invention has been shown and described with reference to the illustrated embodiments, it should be understood that various changes in form and details may be made without departing from the scope of the invention which is defined in the appended claims.

I claim:

1. A method for providing optimal compaction of various materials by an adjustable amplitude vibratory roller comprising the steps of:

disposing at least two transducers at selected locations on elements vibrated by the vibratory roller;

generating signals representative of the vibrations of said elements, the locations of said transducers being selected to provide signals of similar waveform when the vibrations generated by the vibratory roller are regular and signals of dissimilar waveform when the vibrations generated by the vibratory roller are irregular, the dissimilarity being a measure of the magnitude of the difference between the vibrations;

comparing the transducer signals;

providing output signals indicative of the similarity and dissimilarity of the compared transducer signals; and adjusting the amplitude of vibrations of the roller in accordance with the output signals by (a) providing increasing vibration amplitude when the generated vibrations are regular, (b) interrupting the increase and providing decreasing vibration amplitude when the vibrations reach a selected magnitude of irregularity and (c) interrupting the decrease and providing increasing vibration amplitude when the vibrations become regular.

2. A method as defined in claim 1, wherein the vibratory roller includes a roller drum, and wherein the transducers are located in the roller drum and are axially separated from each other.

3. A method as defined in claim 1, wherein the transducers are located on frame elements supported by the roller.

4. A method of providing optimal compaction of various materials by a vibratory roller including an adjustable eccentric element to provide variable amplitude vibrations comprising the steps of:

disposing at least two transducers at selected locations on elements vibrated by the vibratory roller;

generating signals representative of the vibrations of said elements, the locations of said transducers being selected to provide signals of similar waveform when the vibrations generated by the vibratory roller are regular and signals of dissimilar waveform when the vibrations generated by the vibratory roller are irregular, the dissimilarity being a measure of the magnitude of the difference between the vibrations;

comparing the transducer signals;

providing output signals indicative of the similarity and dissimilarity of the compared transducer signals; and adjusting the eccentric element of the roller in accordance with the output signals by (a) providing increasing vibration amplitude of the roller when the generated vibrations are regular, (b) interrupting the increase and providing decreasing vibration amplitude of the roller when the vibrations reach a selected magnitude of irregularity and (c) interrupting the decrease and providing increasing vibration amplitude of the roller when the vibrations again become regular.

5. A method as defined in claim 4, wherein the vibratory roller includes a roller drum, and wherein the transducers are located in the roller drum and are axially separated from each other.

6. A method as defined in claim 4, wherein the transducers are located on frame elements supported by the roller.

7. A method of providing optimal compaction of various materials by a vibratory roller including an adjustable eccentric element to provide variable amplitude vibrations comprising the steps of:

disposing at least two transducers at selected locations on elements vibrated by the vibratory roller;

generating signals representative of the vibrations of said elements, the locations of said transducers being selected to provide signals having similar instantaneous amplitudes when the vibrations generated by the vibratory roller are regular and signals having different instantaneous amplitudes when the vibrations generated by the vibratory roller are irregular, the difference in amplitudes being a measure of the magnitude of the difference between the vibrations;

comparing the transducer signals;

providing output signals indicative of the similarity and differences of the compared transducer signals; and adjusting the eccentric element of the roller in accordance with the output signals by (a) providing increasing vibration amplitude of the roller when the generated vibrations are regular, (b) interrupting the increase and providing decreasing vibration amplitude of the roller when the vibrations reach a selected magnitude of irregularity and (c) interrupting the decrease and providing increasing vibration amplitude of the roller when the vibrations again become regular.

8. A method as defined in claim 7, wherein the vibratory roller includes a roller drum, and wherein the transducers are located in the roller drum and are axially separated from each other.

9. A method as defined in claim 7, wherein the transducers are located on frame elements supported by the roller.

10. Apparatus for providing optimal compaction of various materials by an adjustable amplitude vibratory roller including an adjustable eccentric element to provide variable amplitude vibrations, at least two transducers located at selected locations on elements vibrated by the vibratory roller to generate signals representative of the vibrations, the locations being selected to provide signals of similar waveform when the vibrations generated by the vibratory roller are regular and signals of dissimilar waveform when the vibrations generated by the vibratory roller are irregular, the dissimilarity being a measure of the magnitude of the difference between the vibrations, means for comparing the transducer signals to provide output signals indicative of the similarity and dissimilarity of the compared transducer signals, means for adjusting the eccentric element of the roller in response to the output signals (a) to provide increasing vibration amplitude when the generated vibrations are regular, (b) to interrupt the increase and provide decreasing vibration amplitude when the vibrations reach a selected magnitude of irregularity and (c) to interrupt the decrease and provide increasing vibration amplitude when the vibrations again become regular.

11. Apparatus as defined in claim 10, wherein the vibratory roller includes a roller drum, and wherein the transducers are located in the roller drum and are axially separated from each other.

12. Apparatus as defined in claim 10, wherein the transducers are located on frame elements supported by the roller.

13. Apparatus for providing optimal compaction of various materials by an adjustable amplitude vibratory roller including an adjustable eccentric element to provide variable amplitude vibrations, at least two transducers located at selected locations on elements vibrated by the vibratory roller to generate signals representative of the vibrations, the locations being selected to provide signals having similar instantaneous amplitudes when the vibrations generated by the vibratory roller are regular and signals having different instantaneous amplitudes when the vibrations generated by the vibratory roller are irregular, the difference in amplitudes being a measure of the magnitude of the difference between the vibrations, means for comparing the transducer signals to provide output signals indicative of the similarity and differences of the compared transducer signals, means for adjusting the eccentric element of the roller in response to the output signals (a) to provide increasing vibration amplitude when the generated vibrations are regular, (b) to interrupt the increase and provide decreasing vibration amplitude when the vibrations reach a selected magnitude or irregularity and (c) to interrupt the decrease and provide increasing vibration amplitude when the vibrations again become regular.

14. Apparatus as defined in claim 13, wherein the vibratory roller includes a roller drum, and wherein the transducers are located in the roller drum and are axially separated from each other.

15. Apparatus as defined in claim 13, wherein the transducers are located on frame elements supported by the roller.

* * * * *